United States Patent [19]

Kümmerlin et al.

[11] 4,359,138

[45] Nov. 16, 1982

[54] SUPPORTING DEVICE FOR LADDERS

[76] Inventors: Walter Kümmerlin, In den Fressäckern 6, 7120 Bietigheim-Bissingen; Nikolaus A. Kümmerlin, Humboldstrasse 26, 7220 Schwenningen, both of Fed. Rep. of Germany

[21] Appl. No.: 99,175

[22] Filed: Nov. 30, 1979

[30] Foreign Application Priority Data

Dec. 1, 1978 [DE] Fed. Rep. of Germany ..... 2851987

[51] Int. Cl.[3] ..... E06C 7/14; E06C 7/44; E06C 7/48

[52] U.S. Cl. ..... 182/214; 182/107; 182/121; 182/200; 248/238

[58] Field of Search ..... 182/214, 107, 108, 116, 182/120, 121, 200; 248/210, 235, 238

[56] References Cited

U.S. PATENT DOCUMENTS

| | | | |
|---|---|---|---|
| 1,452,182 | 4/1923 | Butrum | 248/238 |
| 2,327,317 | 8/1943 | Randall | 182/214 |
| 2,881,028 | 4/1959 | Baird | 182/116 |
| 2,903,086 | 9/1959 | Chubbs | 182/214 |
| 3,028,929 | 4/1962 | Chubbs | 182/214 |
| 3,072,218 | 1/1963 | Peters | 182/214 |
| 3,146,854 | 9/1964 | Terwilliger | 182/214 |
| 3,331,577 | 7/1967 | Grunwaldt | 182/121 |
| 3,568,801 | 3/1971 | Werner | 182/214 |
| 3,713,510 | 1/1975 | O'Dell | 182/214 |
| 3,941,341 | 3/1976 | Brogdon | 248/210 |

*Primary Examiner*—Reinaldo P. Machado
*Attorney, Agent, or Firm*—Martin A. Farber

[57] ABSTRACT

A supporting device for ladders which has two supports which can be connected with rungs of the ladder by two connecting devices. The connecting devices form at least one pair of connecting parts which receive two rungs of the ladder in opposite direction, the connecting parts being at a variable distance from each other.

23 Claims, 12 Drawing Figures

SUPPORTING DEVICE FOR LADDERS

Figure 1:
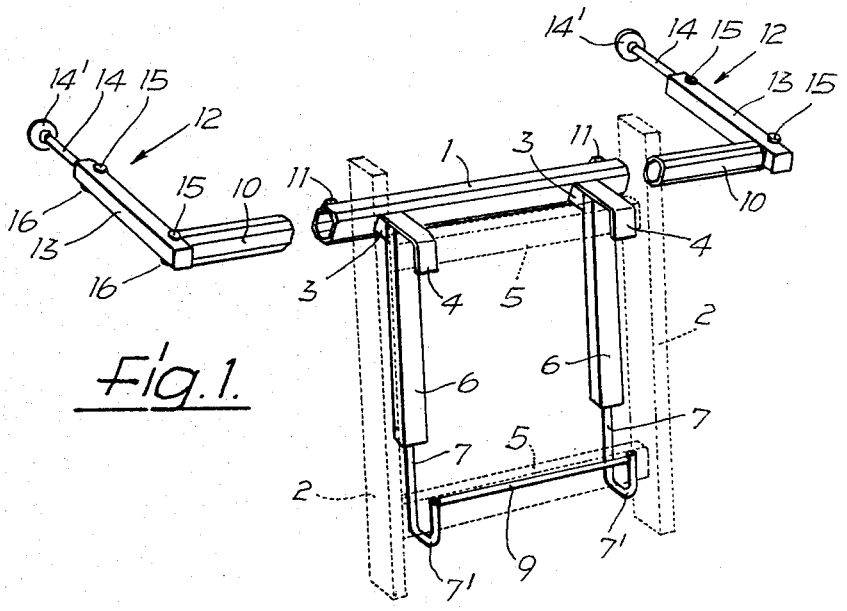

This invention relates to a supporting device for ladders which has two supports which can be connected by connecting means to rungs of the ladder.

The known supporting devices of this type are used for ladders of variable and invariable length in order to hold the upper end of the ladder at a distance from the wall or the like against which the ladder is to be placed. A certain distance of the upper end of the ladder from the wall in many cases facilitates work in the region of the upper end of the ladder and also makes it possible to reach parts which protrude from the wall, such as for instance gutters.

In the case of these supporting devices it is known to connect the supports with each other by two cross members the distance between which is equal to the distance between the rungs. These two cross members, which have a semi-circular or channel profile which is open towards the bottom, are placed from above onto the top rung and the second rung from the top. Straps which engage around these two rungs from the bottom are connected by bolts to the cross members. This arrangement has the disadvantage that, as a result of the fixed distance of the two cross members from each other, the device can be used only for ladders which have a corresponding spacing between their rungs. However, the assembling and disassembling resulting from the clamp-like connection to the rungs must also be considered a disadvantage. Other disadvantages are that the cross members may constitute an obstacle upon going up and down the ladder and that these supporting devices can be used only as wall spacer means.

A clamp-like attachment to the rungs of a ladder is also known in the case of so-called ground leveling feet which are fastened to the lower end of the ladder and have feet of adjustable length which are provided on the ends of a cross member. The purpose of these ground leveling feet is to compensate for differences in level at the place in the region of the feet where the ladder is to be set up, for instance as a result of steps. The disadvantages are the same as in connection with the known wall-spacers.

The object of the present invention is to create a supporting device for ladders which is easy to attach and remove. With a supporting device of the aforementioned type, the object is achieved, in accordance with the invention, in the manner that the connecting means form at least one pair of connecting parts which receive, in opposite directions, two rungs of the ladder, the connecting parts being at a variable distance apart.

With such a development of the supporting device, the attachment and removal is very simple since for this it is merely necessary to suspend the connecting parts, utilizing their variable spacing, on the rungs or to remove them from same. The variable distance between the connecting parts furthermore makes it possible to use ladders having different rung spacings.

The connecting means may each have a bar of variable length, the parts of which which are adjustable with respect to each other bearing the connecting parts. In order that the variable-length bars of the connecting device adapt themselves automatically to the rung spacing, which further simplifies attachment and removal, each of them in a preferred embodiment, consists of a pipe which forms a first section, a second section which is guided in a longitudinally displaceable manner in said first section and a return spring which is arranged in the first section.

Each connecting device can, however, also for instance have a rod on which a longitudinally displaceable sleeve is seated. In this case one connecting part of each pair is rigidly connected with the rod and the other is rigidly connected with the sleeve.

An embodiment which is particularly simple and economical from the standpoint of construction is obtained if the rod adjoins the one end of the associated support at an angle.

In a preferred embodiment, a cross member which bears the supports is spaced, in parallel position to the rungs of the ladder, by at least one spacer from the connecting devices, each of which is provided in the region of the two ends of its longitudinally displaceable rod with the one or the other connecting part of a pair. In this connection each of the supports has a connecting section which is at an angle to it and can be connected, in position coaxial to the cross member, in at least two different angular positions to the spacer.

Such a supporting device can be used even in a more diversified manner since it cannot only be fastened as wall spacer to the upper end of the ladder, but can also be fastened in the region between the ladder ends as a ladder stiffener by preventing excessive bending of the ladder towards the wall which serves as a resting surface, and in particular can also serve as a leveling foot which can be fastened to the lower end of the ladder. Due to the fact that the supports of the supporting device can be connected in different angular positions to the spacer, they can namely, as desired, have the angle of for instance 110° relative to the adjustable-length bars or the side-pieces of the ladder which is necessary for use as a wall spacer or can lie parallel to said bars or the side-pieces of the ladder, as is advantageous upon use as ground leveling foot. In addition to this, as a result of the spacers, the cross member comes to lie at a distance behind the side-pieces of the ladder, as a result of which the supporting device can be used also for ladders with side pieces of different size. Due to the position of the cross member behind the side pieces of the ladder, the ease of movement on the ladder is not impaired. The cross piece can rather, as in the case of a split rung, form an additional stepping surface.

As a rule, it is sufficient to adapt or adjust the distance of the two adjustable-length bars from each other to the minimum distance between the side pieces of the ladder. However, it is also possible without difficulty to provide a connecting part of adjustable length in order to be able to adapt the distance between the two connecting devices to the distance between the side pieces.

In order to be able to lock the supports in the selected angular position in a reliable and simple manner, but nevertheless to be able to transport the device in a space-conserving fashion, a polygonal, preferably octagonal, pipe of regular cross sectional profile can be used for the cross member. The connecting sections of the supports are then imparted a corresponding cross sectional profile, which permits it being placed into or on top of the associated end of the cross member in a manner prevented against rotation. The connecting sections in this case need be further secured only against displacement in longitudinal direction of the cross member, for which a clamping screw, for instance, is sufficient.

The connecting sections are preferably pipe lengths which are firmly connected to these supports at an angle to the associated support in region of the one end of the ladder or at different distances from the two ends. Such a development of the supports is particularly advantageous, especially if the supports have at least two parts which telescopically engage one within the other and are displaceable relative to each other in lengthwise direction, which parts may optionally be lengthened in one or the other direction of the support. As a result, the possibility of adaptation to different heights of the surface on which the ladder is placed is particularly great.

The locking device necessary for the locking in position of the parts of such supports which are displaceable relative to each other can comprise, for instance, a bolt which passes at least partially in transverse direction through the two parts. However, instead of such a locking device or in addition to it there can also be provided, for instance, a locking device in connection with which the inner part has a keyway extending in its longitudinal direction and the outer part, a screw, the end of which protruding into the keyway rests against the bottom of the keyway in the locking position. Such a locking device permits an infinitely variable adjustment of the length of the supports.

With respect to cost of manufacture there is particularly favorable an embodiment in which the spacer has two arms which form a yoke pointing away from the lengthwise adjustable rod, the cross member lying between said arms and being adapted to be connected with them in different angular position by means of a bolt or the like which passes through them and the arms. In this case a round pipe can be used as cross member, since no welding connection is necessary between it and the spacer or spacers. It can consist of a different material than the spacer. For the cross member therefore an aluminum pipe can, for instance be used, and for the spacer or spacers a steel shape or a body bent from a steel plate. Another advantage is that the cross member can be developed integral with the supports. It is then unnecessary to produce a connection between the connecting section of the supports and the supports proper.

The two arms of the spacer can be formed by the two arms of a U-shaped strap (bracket), whereby each one of such type straps are connected by its yoke part to the two lengthwise adjustable rods. The strap may for instance be bent out of a flat material.

However, the two arms can also be formed by the two flanges of a channel bar which extends from one of the two bars of adjustable length to the other and the yoke part of which is connected with the two rods of adjustable length.

The arms advantageously are provided, at different distances from the yoke part, with holes for the passage of the bolt by means of which the cross member is connected in the desired angular position to the spacer. The distance of the cross member from the adjustable-length rods can then be changed and be adapted to ladder side pieces of different thickness. In order that the cross member not be weakened excessively by the holes for the passage of the bolt or the like, in a preferred embodiment their passage openings for the bolts, which openings are staggered in radial direction from each other and by means of which different angular positions of the cross member can be selected, are staggered axially with respect to each other. In such case, to be sure, in order to change the angular position of the cross member it is necessary to displace it approximately in its lengthwise direction with respect to the spacer or spacers. However, this displacement can remain so small that it is not disturbing.

In one preferred embodiment, a shelf is provided which can be placed on the two supports or arranged between them and connected with them via at least two carrying arms as well as placed on the cross member, on which shelf for instance containers or tools can be placed. The expense for such a shelf is very slight and its attachment and removal are extremely easy. The loose placing of the shelf on the cross member is not only advantageous with respect to mounting and removal but also permits automatic adaptation of the shelf to the different angles of the supports relative to the adjustable-length rods of the connecting devices.

The supporting arms of the shelf can preferably be pulled out and provided at their free end with a hook or the like which can be placed on the support so that they can be adapted to different spacings of the supports and be connected with them in particularly simple fashion. For the reliable receiving of tools or the like the shelf can be provided with holes into which the tools can be inserted. Of course, in order to avoid the dropping off or articles placed thereon, the shelf, which may for instance consist of aluminum, can also be provided with a raised edge.

Figure 2:
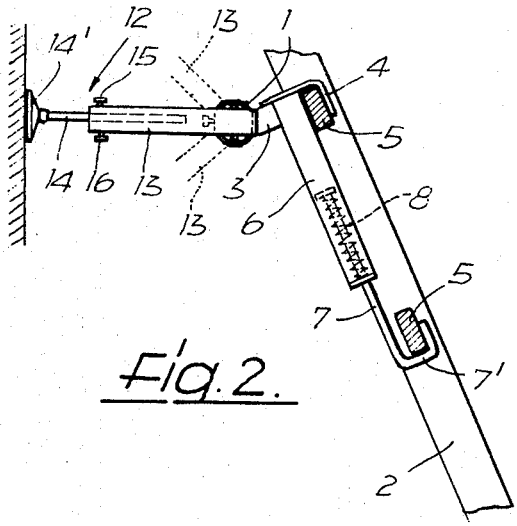
Figure 3:
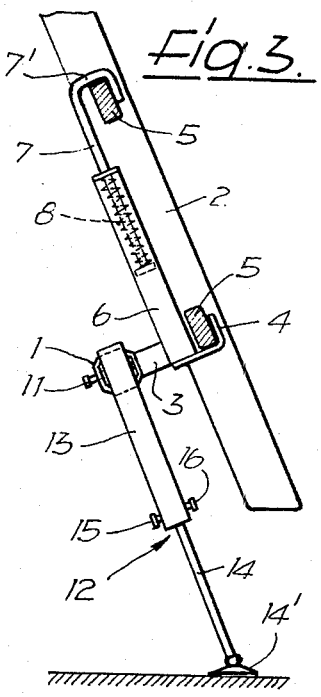
Figure 4:
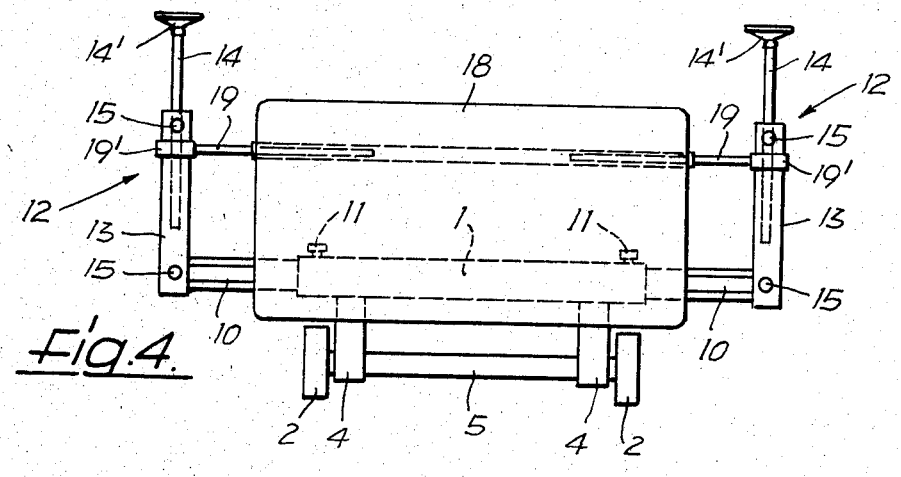
Figure 5:
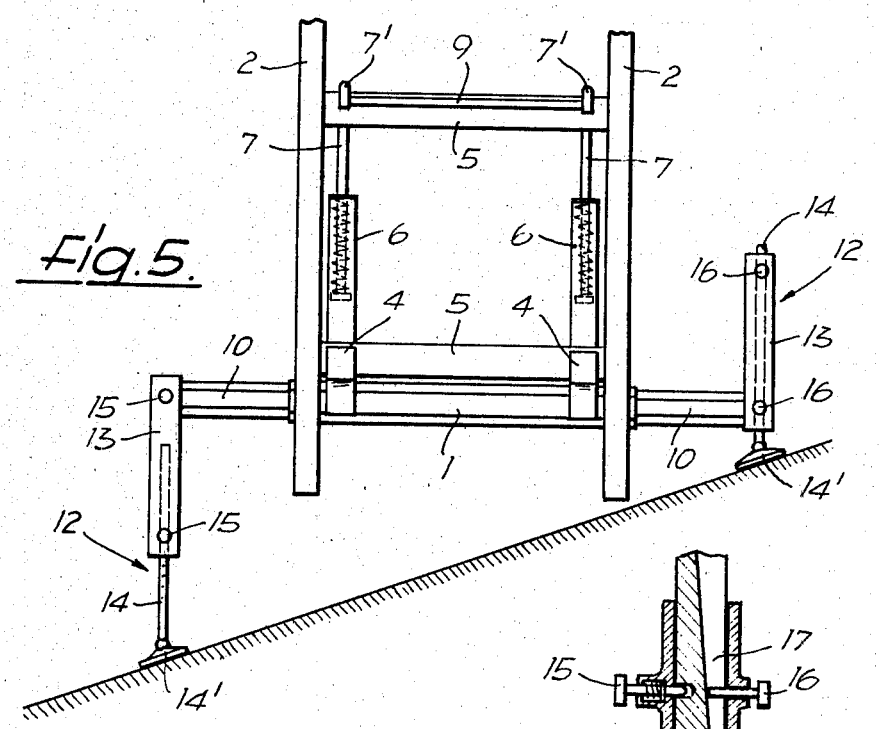
Figure 6:
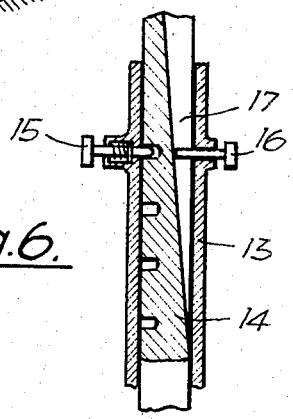
Figure 7:
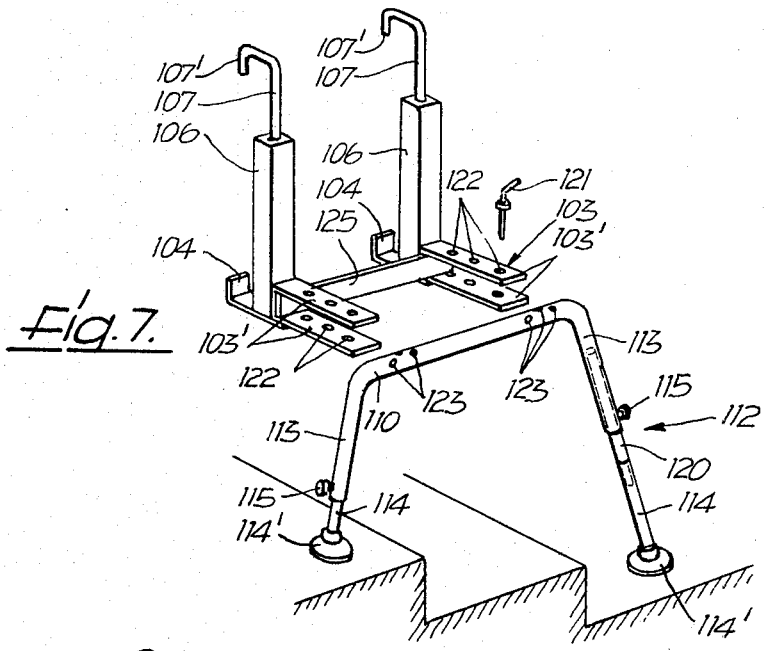
Figure 8:
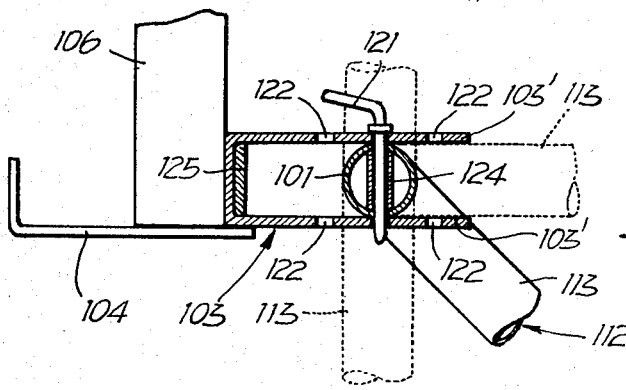
Figure 9:
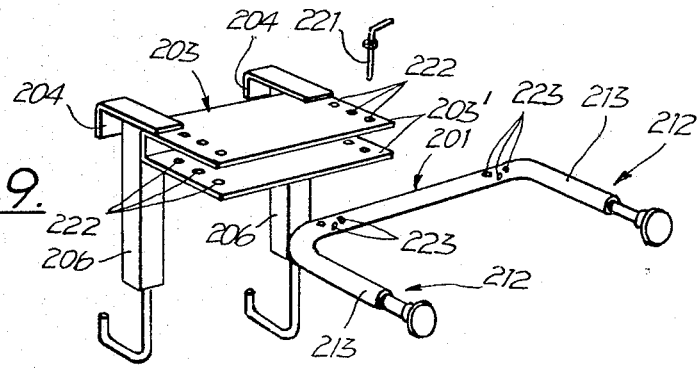
Figure 10:
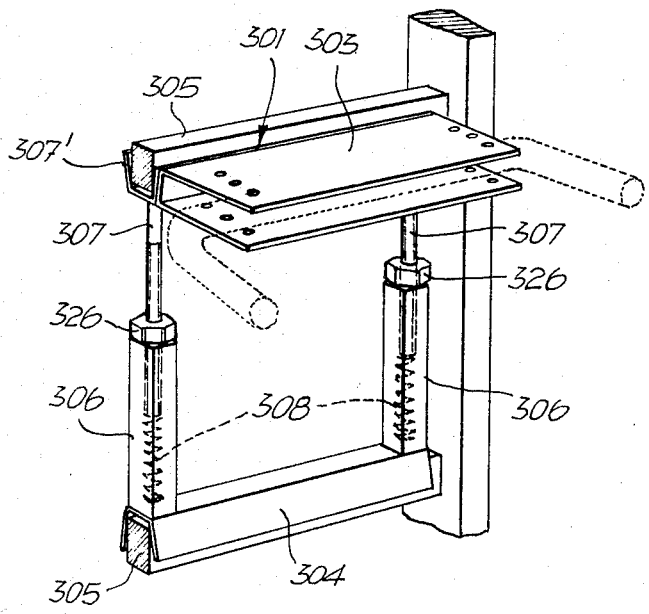
Figure 11:
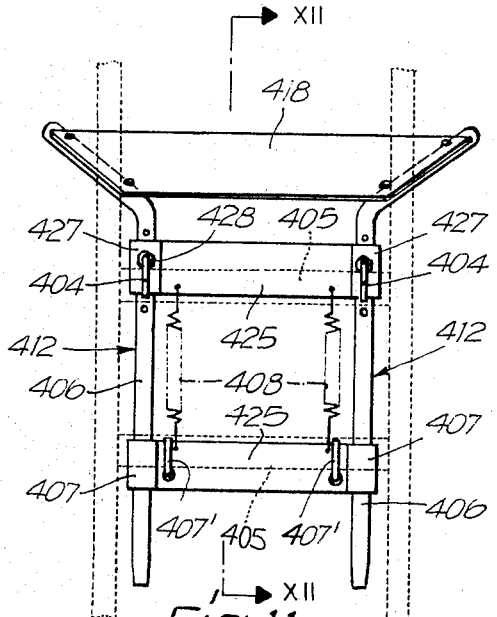
Figure 12:
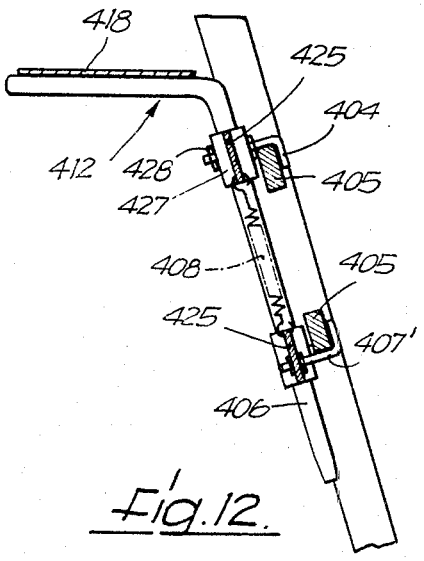

With the above and other objects and advantages in view, the present invention will become more clearly understood in connection with the detailed description of preferred embodiments, when considered with the accompanying drawings, of which:

FIG. 1 is a perspective exploded view of a first embodiment,

FIG. 2 is a longitudinal section through the first embodiment in assembled condition for use as wall spacer or ladder stiffening, FIG. 3 is a longitudinal section through the first embodiment in assembled condition for use as ground leveling base, FIG. 4 is a top view of the first embodiment in assembled condition for use as wall spacer, FIG. 5 is a view of the first embodiment in assembled condition for use as ground leveling base, FIG. 6 is an incompletely shown longitudinal section through one of the supports, FIG. 7 is an exploded view in perspective of a second embodiment, in position as ground leveling base, FIG. 8 is an incompletely shown section through the second embodiment, FIG. 9 is an exploded view in perspective of a third embodiment, in position as wall spacer, FIG. 10 is an incomplete perspective view of a fourth embodiment, FIG. 11 is a view of a fifth embodiment in assembled condition, FIG. 12 is a section along the line XII—XII of FIG. 11.

A supporting device for ladders which can be used as a wall spacer, as a ladder stiffener and as a leveling base has, as shown for instance in FIG. 1, a cross member 1 developed as a regular octagonal pipe, the length of which in the example shown is somewhat greater than the minimum width of a ladder measured from the outside to the outside of the two ladder side pieces 2. From the cross member 1 there protrude in the same radial direction two identically developed spacers 3 which are rigidly connected with the cross member 1, for instance welded to it. The distance between the two spacers 3, which are arranged symmetrically with respect to the center of the cross member and each of which is formed by a pipe length, is only slightly smaller, measured from outside to outside, than the minimum width of the ladder between the two ladder side-pieces 2 so that the two spacers 3 can engage between the ladder side-pieces 2 of ladders of different manufacture and different design. Adjoining the end of the spacer 3 which faces away from the cross member 1 there is provided a hook 4, the shape of which is so selected that it can be attached from above or below in one of the rungs 5 of a ladder. The length of the spacers 3 is so selected that the cross member 1, regardless of the thickness of the ladder side pieces 2 measured in the longitudinal direction of the spacers, comes to lie behind same when the hooks 4 are hooked into a rung 5, as shown in FIGS. 2 and 3.

Each hook 4 forms a part of two connecting devices by means of which the cross member 1 can be fastened to the rungs 5. Each of these two identically developed connecting devices has a pipe length (tube piece) 6, one end of which is firmly connected with the hook 4 and the end of the spacer 3, which end carries the hook 4, and forms—in the embodiment shown by way of example—an angle of about 90° with the spacer. Within the pipe length 6 there is guided in longitudinally displaceable manner a rod 7 which carries at the end thereof lying within the pipe length 6, a spring plate which serves as a guide element and against which one end of a pretensioned compression spring 8, arranged in the pipe length 6, rests, its other end resting against a cover which is firmly connected to the pipe length 6 at the end thereof facing away from the hook 4. The outer end of the rod 7 is shaped into a hook 7' which, as shown by way of example in FIGS. 2 and 3, points towards the hook 4 and therefore is attached in one of the rungs 5 in the direction opposite the hook 4. As a result of the longitudinally displaceable support of the rod 7 in the pipe length 6 and the return force of the compression spring 8, the distance between the hooks 4 and 7' is automatically adjusted to the distance between the rungs. In order to be able to pull both rods 7 out simultaneously with one hand, the two hooks 7' are connected firmly with each other by a connecting strip 9 which lies in front of the rungs and does not constitute an obstacle when stepping on the rungs.

An insertion pipe 10 can be introduced into the cross member 1 at both ends, said pipe having the same cross sectional profile as the cross member 1, but an outside diameter which is adjusted to the inside diameter of the cross member so, that the insertion pipe 10 is guided in a longitudinally displaceable manner in the cross member 1, but is turning relative to the cross member 1. By means of a clamping screw 11 on the front side of the cross member in the two end sections lying outside the spacers 3, the insertion pipes 10 are held fast at the desired depth of insertion.

The two identically developed insertion pipes 10 form the connecting section of two identically developed supports 12. The length of the insertion pipe 10 is therefore selected in accordance with the desired maximum distance between the supports 12. Each of the two supports 12 has a section 13 which is firmly connected with the insertion pipe 10 and is formed of a pipe which is open at both ends. In the embodiment shown by way of example, the insertion pipe 10 protrudes in radial direction from one end of the section 13. The insertion pipe 10 could however also form a different angle with respect to the section 13 and be firmly connected with the section 13 at different distances from the two ends of the section.

A rod 14 is guided in the two sections 13 longitudinally displaceable and completely removable from the section 13. The rod 14 carries at its outer end in the embodiment shown by way of example a pivoted plate 14' in order to increase the resting surface. In order to fix the rod 14 at the selected length of extension it is provided with transverse boreholes into which there can engage, depending on the direction of insertion, one of the two spring-loaded locking bolts 15 which are provided on the section 13 in the region of the one or other end thereof. This lengthwise displaceability makes it possible not only to select differently large wall spacings for the upper end of the ladder, but also to adapt the length of the support to the distance of the ladder from the wall in the region between the two ladder ends and therefore upon use of the supporting device as ladder stiffener, as shown in FIG. 2. In the embodiment shown by way of example, in addition to the locking bolts 15 there are provided opposite the latter, on the two sections 13, fastening screws 16 which can engage in radial direction into a groove 17 which deepens towards the free end of the rod 14. By means of these fastening screws 16 which can be brought against the bottom of the groove 17 an infinitely variable adjustment of the rods 10 is possible within a certain range of adjustment. This is advantageous in particular when using the supporting device as a leveling foot and as a ladder stiffener. The reason why in each case two locking bolts 15 and two fastening screws 16 are provided is that when using the supporting device as a leveling base, it may be advantageous to insert the rods 14 in a different direction into the associated section 13 and to place the two sections 13 also in a different direction on the cross member 1, as shown in FIG. 5. In that figure, the section 13 which is shown on the left extends downwards from the insertion pipe, 10 while the section 13 shown on the right extends upward from its insertion pipe. In this way a greater difference in level of the resting surfaces can be compensated for with a given length of the sections 13 and the rods 14.

As shown in particular in FIG. 3, when the supporting device is used as a leveling base, the hooks 4 engage into the lowermost rung from below and the upward facing side of the cross member 1 which is located behind the ladder side-pieces 2 is located in this case approximately at the same height as the stepping surface of this rung. The user of the ladder can therefore step simultaneously on the rung and on the cross member. The stability of the user is therefore not impaired by the cross member but rather further improved. Insofar as it is desired to adjust the distance between the two spacers 3 to the larger ladder width which is generally present at the lower end of the ladder as compared with the upper end thereof, this could be done by making the cross member 1 telescopically extendable. As a rule, however, such a development is not necessary.

As shown in FIG. 4, on the cross member 1, there can be placed one edge zone of a shelf 18 on whose bottom there are provided, in the region of the opposite edge zone, two supporting arms 19 which lie parallel to the cross member 1 and can be pulled out in direction opposite to the support 12 adjacent to it so that the hook 19' provided on the free end thereof can be placed, with different distances apart of the supports 12, from above onto the section 13. By means of the shelf 18 the space between the ladder and the wall against which the supports 12 rest is utilized in order to be able to conveniently place containers, tools or the like thereon.

Since the shelf 18 and the supporting arms 19 are placed only on the cross member 1 or the section 13, it automatically adapts itself to different angular positions of the supports relative to the cross member 1. Furthermore, it can be removed for transportation from the cross member 1, which is also true of the supports 12, as a result of which the entire supporting device can be compactly transported.

FIGS. 7 and 8 show an illustrative embodiment of the supporting device of the invention which, like the previously described embodiment, is placed on the ladder and can be used as desired as wall spacer, ladder stiffener or ground leveling base. Its two connecting devices, which can be placed on the rungs of a ladder are developed in the same manner as those of the first embodiment and therefore each consists of a pipe length 106 in which a rod 107 is guided for longitudinal displacement and can be pulled out in opposition to the force of a restoring spring, the free end of said rod being shaped as a hook 107'. Facing this hook 107' is a hook 104 which is fastened corresponding to the hook 4, to the free end of the pipe length 106.

The cross member 101 is formed in this embodiment by the central section of a strap produced from an aluminum pipe the two arms of which diverging towards its free end form the outer section 113 of two supports designated generally as 112. In the embodiment shown by way of example the angle between the supports 112 and the cross member 101 is greater than 90°, for instance 105°. The two supports 112 could, however, also be at a right angle to the cross member 101. Together with it they define a plane, as is also true in the case of the first embodiment. The development of the outer part 113 of the supports 112, over a connecting section 110 forming the transition into the cross member, and the cross member 101 as a single piece has the advantage of lower cost of manufacture than a welded construction, such as contemplated in the first embodiment.

In the outer part 113 of each support 112 there is longitudinally displaceable, adapted to be locked in the selected position of extraction by a fastening screw 115, a rod 114 which at its free end bears an articulated plate 114'. If the maximum length of the supports 112 which can be obtained by means of the rod 114 is not sufficient, the rods 114 can be lengthened, as shown in FIG. 7, by attaching to the end thereof normally lying within the outer part 113 one or more extension rods 120 which are provided at their one end with a pin which can be inserted or screwed into the rod 114 or another extension rod. The extension rods 120 have the same outside diameter as the rods 114 so that they can be introduced in place thereof into the outer parts 113.

The connecting of the cross member 101 to the two connecting devices, is effected in the same way as in the first embodiment, by means of two identically developed spacers 103 which, however, are not developed as pipe lengths but as U-shaped forks the yoke portions of which are firmly connected with the pipe length 106 of the one or other connecting device, for instance welded thereto, in such a manner that the two arms 103 thereof which are parallel to each other protrude at an angle from the pipe length 106 on the side opposite the hook 104. In the embodiment shown by way of example it is a right angle. Since the length of the arms 103 in the embodiment shown by way of example is substantially greater than their distance from each other which corresponds to the diameter of the cross member 101, the spacers 103 are not sections of a U-shaped channel in the embodiment shown as example but are bent out of flat material.

As shown in FIG. 7, the space between the two arms 103' of the one spacer is aligned with the corresponding space of the other spacer since the purpose of the arms 103' is to receive the cross member 101 between them. The form-locked (positive) connection between the cross member 101 and the arms 103' is effected by means of two insertion bolts 121 which pass through boreholes 122 in the arms 103' and boreholes 123 in the cross member 101.

The boreholes 123 form three pairs each of which is coaxial, the axial spacing of the corresponding pair being in each case equal to the axial distance of the boreholes 122 in the one arm 103' from the corresponding borehole 122 in the other arm. As shown in FIG. 8, the boreholes 123 in the cross member are so staggered in their angular position that the supports 112 can be fixed in an angle of 0°, 90°, and 105° with respect to the longitudinal axis of the pipe length 106 and thus also the longitudinal axis of the side-pieces of a ladder. In FIG. 8 the position with an an angle of 105° is shown in solid lines and the other two positions are shown in dashed lines. In order that the cross member 101 is not too greatly weakened in the region of the boreholes 123 by said boreholes, the boreholes associated with the different angular positions are staggered somewhat with respect to each other in the longitudinal direction of the cross member 101, as shown in FIG. 7. Upon transfer from the 90° position to the 105° position the cross member 101 must therefore be pushed somewhat to the one side in its longitudinal direction and upon transfer to the zero position pushed somewhat towards the other side. In order to facilitate the passing of the insertion bolt 121 through the cross member 101, sleeves 124 are inserted into the bore hole 123.

As shown in FIG. 7, the arms 103' have several boreholes 122 which are at different distances from the pipe lengths 106. To be sure, in each case one of the boreholes 122 of each arm of the pipe length 106 has the same spacing as a corresponding borehole of the other arm so that the cross member 101 always lies parallel to a connecting rod 125 which extends from the yoke part of the one spacer 103 to the yoke part of the other spacer 103 and is rigidly connected with them in a position at right angles to the longitudinal axis of the pipe length 106.

In the same way as in the first embodiment, a shelf, not shown in FIGS. 7 and 8, can be placed on the cross member 101 and the supports 112.

The third embodiment, which is shown in FIG. 9, is substantially the same as the second embodiment shown in FIGS. 7 and 8. Therefore this embodiment will be explained below only insofar as it differs from the second embodiment. Otherwise reference is had to the remarks concerning the latter.

Instead of the two spacers 103 and the connecting rod 125 connecting them together there is provided in the third embodiment a single spacer 203 which has a U-shaped cross-sectional profile with arms 203' parallel to each other and extends from a pipe length 206 of the one connecting device to the pipe length 206 of the other connecting device. As shown in FIG. 9, the yoke part of the spacer 203 is firmly connected to said two pipe lengths 206, for instance welded. The yoke part of the spacer 203 therefore replaces the connecting rod 125. In the embodiment shown by way of example, the spacer 203 is bent out of a steel pipe since its own two arms 203', as in the case of the embodiment of FIGS. 7 and 8, are relatively long as compared with their distance apart, which is adapted to the diameter of the cross member 201. With a shorter arm length there could of course also be employed a section of a U-shaped rod. The arms 203', which protrude on the side of the pipe lengths 206 lying opposite the hook 204 and are parallel to each other are each provided with a series of boreholes 222 in order to be able to change the distance of the cross member 201 from the pipe lengths 206, for instance in order to adjust to different thicknesses of side pieces. The cross member 201 which like the cross member 101 is integral with the outer part 213 of the two supports 212 has, like the cross member 101, in different angular positions boreholes 223 which are somewhat staggered with respect to each other in the longitudinal direction of the cross member. In this way the cross member 201, like the cross member 101, can be connected in form-locked (positive) fashion with the spacer 203 by means of two insertion bolts 221 in different angular positions with respect to the pipe lengths 206.

As shown in FIG. 10, the connecting devices of the supporting device of the invention can be connected to the rungs 305 of a ladder rather than by hooks which face each other, also by means of forks 304 and 307', which point in opposite directions. In the embodiment shown by way of example, the forks are formed by two rails of channel-shaped profile, the distance between the arms of these channel rails increasing towards the end of the arm so as to be able to receive the rungs 305 without play between the arms. The profiled rails extend from the one connecting device to the other at a right angle to the longitudinal axis thereof and connect the two connecting devices firmly together. The profiled rail which forms the forks 304 is welded by means of its yoke part to the free end of the first section 306 of the two adjustable length rods which is developed as pipe. The profile rail forming the forks 307' is welded by its yoke part to the free end of a threaded rod 307 which engages displaceably in its longitudinal direction into the pipe 306 and carries a nut 326 which comes to a stop or abutment against that end of the pipe 306 from which the threaded rod 307 extends.

For the easier handling of the connecting devices a compression spring 308 is arranged in each of the two pipes 306, said spring urging the threaded rod 307 out of the pipe 306. Complete pushing out thereof is prevented by a stop, not shown. The two connecting devices, however, are operable also without these springs 308.

The connection of the cross member 301 to the two connecting devices 304, 306, 307, 307' is effected, as in the embodiment in accordance with FIG. 9, by means of a spacer 303 which has two parallel arms which receive the cross member 301 between them and has its yoke part firmly connected to the two connecting devices. In the embodiment shown by way of example, the yoke part of the spacer 303 is welded to one arm of the rail 307'. However, it could, of course, also be welded to the yoke part of the rail 304 or directly to the two pipes 306. Of course it would also be possible to provide spacers as in the embodiment shown in FIGS. 1 to 6 or in the embodiment in accordance with FIGS.7 and 8 since the two connecting devices shown in FIG. 10 can also be combined with any other embodiment of the device in accordance with the invention.

For placing the device on a ladder, the two adjusting nuts 326 are moved to such an extent that the two adjustable-length rods 306, 307 together with their forks 304 and 307' respectively can be introduced between two rungs 305 of a ladder. In the position of insertion shown in FIG. 10, the fork 304 is then inserted from above onto the one rung 305 and the fork 307' is inserted from below onto the rung 305 located above same. A compression spring 308 which is possibly present in this connection assists in the lengthening of the two rods 306, 307 by the amount necessary for a dependable grasping of the rungs 305. As a result of the divergent arms of the forks, the rungs 305 are grasped without play. It is now merely necessary to turn the adjustment nuts 326 until they come against the pipe length 306. The distance between the two forks 304 and 307' can then no longer change.

The placement of the connecting devices on the ladder in the reverse position, and therefore with the spacer 303 lying at the bottom, is effected in corresponding manner. In order to remove the device of the invention from the ladder it is merely necessary to unscrew the adjustment nuts 326 sufficiently from the end of the pipe length 306 in order to be able to shorten the two adjustable-length rods to the required extent.

In contradistinction to the embodiments which have been described up to now, the angle of the supports 412 with respect to the ladder cannot be varied in the embodiment shown in FIGS. 11 and 12. Because of this, however, the development of this embodiment is particularly simple.

As shown in FIGS. 11 and 12, the two supports 412 which are made of aluminum pipe are integral with the rod 406 of one or other connecting device. The angle which the pipe 406 forms with the corresponding support 412 is so selected that, with the customary inclination of the ladder, the supports lie approximately horizontal so that the shelf 418 also lies approximately horizontal, which shelf, as shown in FIG. 11, can be placed on the two supports 412 and, in the embodiments shown in the drawing, connected with them by pins which engage in boreholes in the supports.

On each of the rods 406 there can be placed two identically developed sleeves 407 and 427 respectively. Both the two sleeves 407 and the two sleeves 427 are firmly connected with each other by struts 425 of the same length, which are parallel to the ladder rungs. That one of the two struts 425, which connects the sleeves 407 together, bears two hooks 407' which, with the use of the embodiment shown in FIG. 12 as a wall spacer, grip from below around one of the rungs 405 of the ladder. The two other hooks 404, which in this type of use grip around the next higher rung from above are provided with a threaded shank which passes through the sleeve 427 and the pipe 406 in radial direction and thereby connects the two together. By means of nuts 428 on the threaded shank, the latter can be displaced in its longitudinal direction so as to adapt the hook width to the requirements. As shown in FIG. 11, the pipes 406 are so pinned with the sleeves 427 that the supports 412 diverge towards their free end.

Two springs 408 which extend from one strut 425 to the other strut 425 make it certain that in an assembled condition not only the hooks 404 which point to the hooks 407' but also the hooks 407' which point to the hooks 404, remain resting against the associated rung.

Of course, in this embodiment instead of the sleeves bearing the hooks 407' one could provide two rods which, like the rods 7 of the first embodiment, are guided in a longitudinally displaceable manner in the pipe section 406. In the same way one could, for instance, in the embodiments in accordance with FIGS. 1 to 9, replace the rods 7 and 107 respectively by such sleeves. Furthermore, a cross member which holds the supports preferably in the selected angular position could be connected with the sleeves 427, either directly or via spacers.

We claim:

1. A supporting device for ladders comprising supports, at least two connecting means for operatively connecting the supports respectively with rungs of a ladder, said connecting means form at least one pair of connecting parts which are adapted to receive two rungs of the ladder in opposite directions, said connecting parts being adjustably mounted at variable distances from each other, each said connecting means includes a rod, a displaceable sleeve is mounted longitudinally displaceably on said rod, one of said connecting parts of said one pair is rigidly connected with said rod, the other of said connecting parts of said one pair is rigidly connected with said sleeve, two detachably mounted sleeves fixed to each of said rods, respectively, single struts are rigidly connected to said displaceable sleeves and to said two detachable mounted sleeves, respectively.

2. The supporting device according to claim 1, wherein said rods integrally connect at an angle a free end of said supports, respectively.

3. The supporting device for ladders, according to claim 2, further comprising a shelf mountable between and on said supports.

4. The supporting device for ladders, according to claim 3, further comprising supporting arms mount said shelf on said supports, said supporting arms are extendably mounted on and relative to said shelf, said arms each have a free end, support hooks mounted on said free end of each of said supporting arms, respectively, said support hooks are engagable with said supports, respectively.

5. A supporting device for ladders comprising supports, at least two connecting means for operatively connecting the supports respectively with rungs of a ladder, said connecting means form at least one pair of connecting parts which are adapted to receive two rungs of the ladder in opposite directions, said connecting parts being adjustably mounted at variable distances from each other, a cross member operatively carries said supports, at least one spacer means disposed between said cross member and said connecting means, said spacer means for spacing said cross member from said connecting means in parallel position to the rungs of the ladder, two connecting section means connectable to said supports, respectively, forming an angle therewith and for connecting to said cross member in a position coaxial to said cross member in at least two different angular positions relative to said spacer means, said spacer means has two arms forming a fork pointing away from said lengthwise adjustable rod means, said cross member is disposed between said arms, bolt means for connecting said cross member with said arms in different angular positions, said bolt means extends through said cross member and said arms.

6. The supporting device according to claim 5, wherein said spacer means constitutes a U-shaped bracket, said two arms constitute two arms of said U-shaped bracket, said bracket has a yoke part between said two arms fastened to said lengthwise adjustable rod means.

7. The supporting device according to claim 5, wherein said adjustable rod means constitute two lengthwise adjustable rod means, said spacer means constitutes one channel bar member having said two arms thereon, said channel bar member extends from one of said lengthwise adjustable rod means to the other of said lengthwise adjustable rod means, said channel bar member has a yoke part between said two arms which is connected with said two lengthwise adjustable rod means.

8. The supporting device according to claim 5, wherein said two arms are formed with holes therein spaced at different distances from said yoke part, said holes are adapted for insertion of said bolt means therein.

9. The supporting device according to claim 44, wherein said cross member is formed with passage openings staggered in radial direction with respect to each other and adapted for insertion of said bolt means therein.

10. The supporting device according to claim 9, wherein said passage openings are arranged staggered axially from each other.

11. The supporting device according to claim 5, wherein said cross member is formed integral in one-piece with said connecting section means of said supports.

12. The supporting device according to claim 5, wherein each said connecting means further includes a lengthwise adjustable rod means, said rod means comprises members displaceable relative to each other, said members each respectively carry said connecting parts.

13. A supporting device for ladders comprising supports, at least two connecting means for operatively connecting the supports respectively with rungs of a ladder, said connecting means form at least one pair of connecting parts which are adapted to receive two rungs of the ladder in opposite directions, said connecting parts being adjustably mounted at variable distances from each other, said supports each comprise, at least two pieces which engage telescopically in each other and are displaceable relative to each other in lengthwise directions, at least one locking means for securing said at least two pieces in a selected position, said locking means comprises, a bolt passing in a locking direction at least partially through each of said two pieces in a transverse direction, and/or said pieces constitute an outer part and an inner part, the latter formed with a groove extending in a longitudinal direction of said inner part, a screw guided in said outer part and having an end of said screw extending into said groove abutting in locking position against a base of said groove, said groove is inclined towards a longitudinal axis of said support.

14. A supporting device for ladders comprising supports, at least two connecting means for operatively connecting the supports respectively with rungs of a ladder, said connecting means form at least one pair of connecting parts which are adapted to receive two rungs of the ladder in opposite directions, said connecting parts being adjustably mounted at variable distances from each other, each said pair of connecting parts constitutes two forks facing away from each other.

15. The supporting device according to claim 14, wherein said forks constitute rails of a U-shaped profile, said rails extend in a lengthwise direction of the rungs of the ladder from one of said connecting means to another of said connecting means and rigidly connect said connecting means together.

16. The supporting device according to claim 15, wherein said rails have two leg ends and widen in a direction towards said leg ends.

17. A supporting device for ladders comprising supports, at least two connecting means for operatively connecting the supports respectively with rungs of a ladder, said connecting means form at least one pair of connecting parts which are adapted to receive two rungs of the ladder in opposite directions, said connecting parts being adjustably mounted at variable distances from each other, each said connecting means further includes a lengthwise adjustable rod means, said rod means comprises members displaceable relative to each other, said members each respectively carry said connecting parts, means for releaseably fixing said members of said rod means relative to each other against movement in at least one direction, said releaseably fixing means comprises a nut threadably mounted on one of said members of said lengthwise adjustable rod means, said one of said members constituting a threaded rod, said nut abuts against one end of the other of said members, said other of said members is formed as a tube.

18. A supporting device for ladders comprising supports, two upper hooks constituting means for engaging around an upper rung of a ladder from above the upper rung, two lower hooks facing toward said upper hooks, said two lower hooks constituting means for engaging around a lower rung of the ladder from under the lower rung, two parallel longitudinal rods having upper ends integral in one-piece with said supports, respectively extending angularly outwardly and substantially perpendicularly therefrom, said rods being formed with a plurality of pairs of rod openings adjacent said upper ends, first sleeves slidably mounted on said rods, respectively, said first sleeves being formed with one pair of sleeve openings selectively aligned with one of said pairs of rod openings, said two upper hooks each include a shank detachably extending through said aligned pairs of rod and sleeve openings, a first strut is connected to and between said first sleeves, second sleeves slidably mounted on said rods under said first sleeves respectively, a second strut is connected to and between said second sleeves, said two lower hooks are mounted on said second strut, spring means for operatively biasing said struts towards each other.

19. The supporting device for ladders, as set forth in claim 18, further comprising means for continuously adjusting said two upper hooks to the thickness of said upper rung.

20. The supporting device for ladders, according to claim 19, wherein said continuously adjusting means comprises, said shank is threaded, and lock nuts threaded on said shanks engaging said first sleeves adjacent said sleeve openings, respectively.

21. The supporting device for ladders, according claim 18, comprising a horizontal platform is secured to said supports.

22. A supporting device for ladders comprising supports, two upper hooks constituting means for engaging around an upper rung of a ladder from above the upper rung, two lower hooks facing toward said upper hooks, said two lower hooks constituting means for engaging around a lower rung of the ladder from under the lower rung, longitudinally continuously adjustable rods, said two upper hooks and said two lower hooks are mounted respectively on said rods, whereby the spacing between the hooks is adjustable to the spacing between the rungs of the ladder, connection means for operatively connecting said supports to said hooks, a cross member operatively carrying said supports, at least one spacer means being disposed between said cross member and said connecting means, said spacer means for spacing said cross member from said connecting means in parallel position to the rungs of the ladder, two connecting section means connectable to said supports, respectively, forming an angle therewith and for connecting to said cross member in a position coaxial to said cross member in at least two different angular positions relative to said spacer means, said spacer means constituting pipe sections of identical length welded to said cross member and to said adjustable rods, respectively.

23. A supporting device for ladders comprising supports, two upper hooks constituting means for engaging around an upper rung of a ladder from above the upper rung, two lower hooks facing toward said upper hooks, said two lower hooks constituting means for engaging around a lower rung of the ladder from under the lower rung, longitudinally continuously adjustable rods, said two upper hooks and said two lower hooks are mounted respectively on said rods, whereby the spacing between the hooks is adjustable to the spacing between the rungs of the ladder, connection means for operatively connecting said supports to said hooks, means for releaseably fixing said adjustable rods relative to each other against movement in at least one direction, said releaseably fixing means comprises a nut adjustably screwed on one of said rods and abutting another of said rods.

* * * * *

UNITED STATES PATENT AND TRADEMARK OFFICE

CERTIFICATE OF CORRECTION

PATENT NO. : 4,359,138

DATED : November 16, 1982

INVENTOR(S) : Walter Kümmerlin, et al

It is certified that error appears in the above-identified patent and that said Letters Patent are hereby corrected as shown below:

Column 12, Line 36, (claim 9) "44" should read --5--

Signed and Sealed this

First Day of February 1983

[SEAL]

Attest:

GERALD J. MOSSINGHOFF

Attesting Officer

Commissioner of Patents and Trademarks